US008397802B2

(12) United States Patent
Lembcke

(10) Patent No.: US 8,397,802 B2
(45) Date of Patent: Mar. 19, 2013

(54) SWELLABLE PACKER SLIP MECHANISM

(75) Inventor: Jeffrey J. Lembcke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 366 days.

(21) Appl. No.: 12/795,422

(22) Filed: Jun. 7, 2010

(65) Prior Publication Data

US 2011/0297368 A1 Dec. 8, 2011

(51) Int. Cl.
*E21B 33/129* (2006.01)

(52) U.S. Cl. ..... 166/118; 166/138

(58) Field of Classification Search ..... 166/179, 166/118, 138

See application file for complete search history.

(56) References Cited

U.S. PATENT DOCUMENTS

| | | | | |
|---|---|---|---|---|
| 6,877,567 | B2 | 4/2005 | Hirth | |
| 7,552,768 | B2 | 6/2009 | O'Brien | |
| 2004/0016550 | A1 | 1/2004 | Dearing | |
| 2008/0190600 | A1 | 8/2008 | Shkurti et al. | |
| 2008/0314591 | A1 | 12/2008 | Hales et al. | |
| 2009/0065192 | A1 * | 3/2009 | Lucas | 166/119 |
| 2009/0179383 | A1 | 7/2009 | Koloy et al. | |
| 2009/0194273 | A1 | 8/2009 | Surjaatmadja et al. | |
| 2009/0211767 | A1 | 8/2009 | Nutley et al. | |
| 2009/0211770 | A1 | 8/2009 | Nutley et al. | |
| 2009/0260801 | A1 | 10/2009 | Nutley et al. | |
| 2009/0272546 | A1 | 11/2009 | Nutley et al. | |
| 2009/0294118 | A1 | 12/2009 | Clemens | |
| 2009/0294128 | A1 | 12/2009 | Dale et al. | |
| 2010/0032158 | A1 | 2/2010 | Dale et al. | |
| 2010/0096119 | A1 | 4/2010 | Sevre et al. | |
| 2010/0276137 | A1 * | 11/2010 | Nutley et al. | 166/185 |
| 2011/0005779 | A1 * | 1/2011 | Lembcke | 166/387 |

FOREIGN PATENT DOCUMENTS

| | | |
|---|---|---|
| GB | 2385352 | 8/2003 |
| GB | 2411918 | 9/2005 |
| WO | 2008060297 | 5/2008 |

OTHER PUBLICATIONS

"Weatherford—Cased-Hole Completions—Fraxsis® Annulus Swellable Packer" Information Sheet, © 2009 Weatherford.

Great Britain Search Report and Search Opinion for GB Application No. 1104287.6, dated Apr. 7, 2011, 4 pages.

* cited by examiner

*Primary Examiner* — Brad Harcourt

(74) *Attorney, Agent, or Firm* — Wong, Cabello, Lutsch, Rutherford & Brucculeri, LLP

(57) ABSTRACT

A packer having a swellable element is configured for axial expansion of the swellable element. The axial expansion causes the slip mechanism to deploy and engage a sidewall of a tubular or casing. The axial expansion may directly cause activation of the slip mechanism, or may trigger a triggering mechanism to activate a spring-loaded slip mechanism. The swellable element may be the same element used for sealing the packer to the sidewall, or may be a sleeve dedicated for deployment of the slip mechanism.

20 Claims, 7 Drawing Sheets

SWELLABLE PACKER SLIP MECHANISM

TECHNICAL FIELD

The present invention relates to the field of downhole tools, and in particular to a slip mechanism for a swellable packer.

BACKGROUND ART

Swellable packers have packing elements composed of a swellable material, such as a swellable elastomer. One commercially available swellable packer is the FRAXSIS® series annulus swellable packer available from Weatherford International Ltd. ("FRAXSIS" is a UK registered trademark of Swelltec Limited.). The packer has a swellable elastomer bonded thereto. When deployed downhole and subjected to an activating agent (such as water, oil, or both), the swellable material swells on the packer and eventually engages a surrounding sidewall of a tubular or open hole.

In some cases, operators may want to anchor a swellable packer in an open hole. In these situations, devices, such as the ROK-ANKOR® slip mechanism from Petrowell Limited, can be included on the tubing string as separate anchoring devices. ("ROK-ANKOR" is a UK registered trademark of Petrowell Limited.) However, these device require separate setting procedures and complicate the arrangement of components on the tubing string.

SUMMARY OF INVENTION

A packer having a swellable element is configured for axial expansion of the swellable element. The axial expansion exerts force on a slip mechanism, causing the slip mechanism to deploy and engage a sidewall of a tubular or casing. The swellable element may be the same element used for sealing the packer to the sidewall, or may be a sleeve dedicated for deployment of the slip mechanism.

In one embodiment, a packer is disclosed. The packer comprises a mandrel, an axially swellable element disposed on the mandrel; and a first slip mechanism disposed on the mandrel with the axially swellable element, the slip mechanism activated by axial swelling of the element.

In another embodiment, a swellable element system is disclosed for disposal on a mandrel. The swellable element system comprises an elastomeric element, configured to swell axially when subjected to a predetermined activating agent; and a backup ring, moveably disposed with an end portion of the elastomeric element, configured to retain the end portion of the elastomeric element upon axial expansion of the elastomeric element.

In yet another embodiment, a downhole tool setting method is disclosed. The method comprises deploying a packer having a swellable element downhole; activating the swellable element to swell axially on the packer; and activating a slip mechanism of the packer responsive to axial swelling of the swellable element.

These and other embodiments are disclosed herein. The foregoing summary is not intended to summarize each potential embodiment or every aspect of the present disclosure.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts are understood to reference all instance of subscripts corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Figure 1:
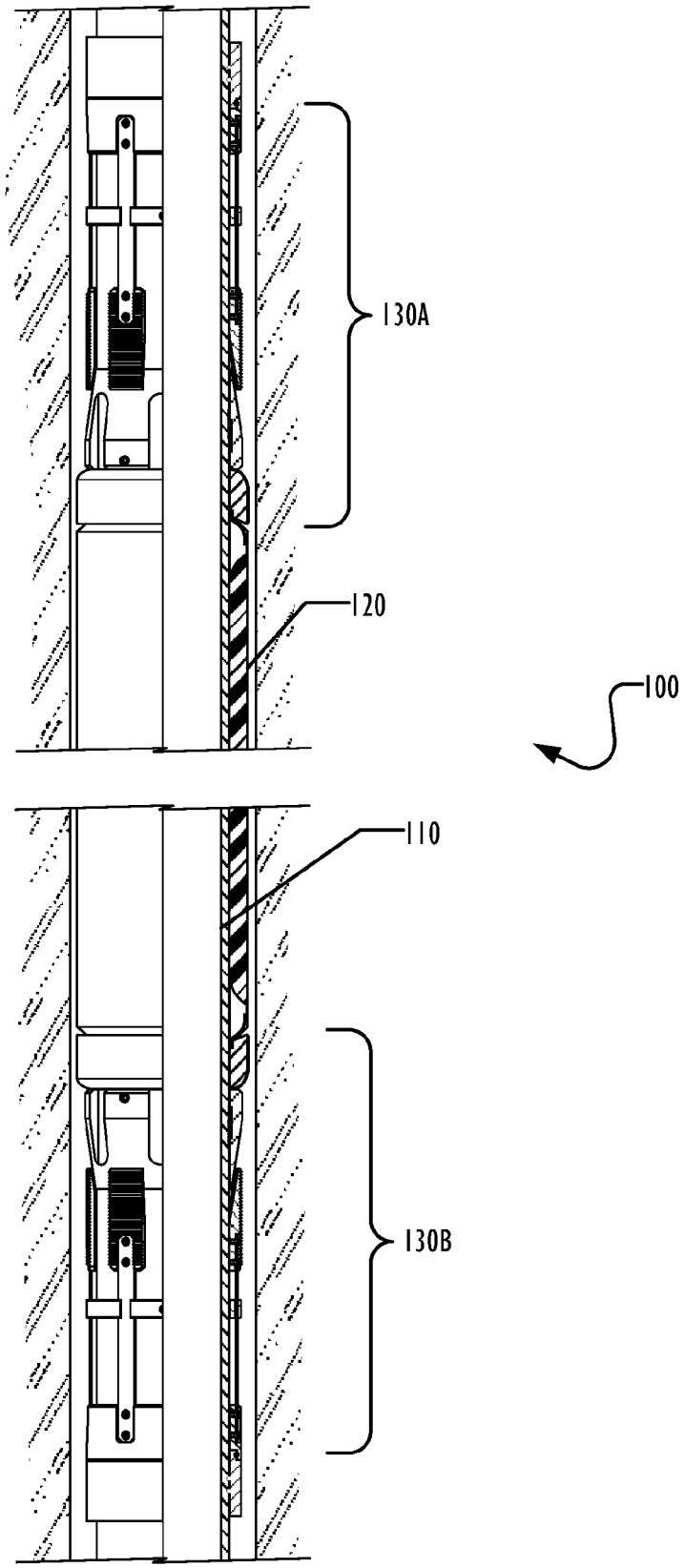
FIG. 1 is a cutaway view illustrating a packer having a swellable element and slip mechanisms according to one embodiment.

In one embodiment, a packer 100 as illustrated in FIG. 1 has a swellable element 120 and slip mechanisms 130A-B disposed on a mandrel 110. The slip mechanisms 130A-B may be disposed on each end of the swellable element 120. The slip mechanisms 130A-B can be a liner hanger TSP style slip mechanism, although any of the other available types of slip mechanisms known in the art could be used. Some preferred details for constructing a downhole packer having a swellable element are disclosed in US Pat. Pub. Nos. 20090272546, 20090260801, 20090211770, and 20090211767, which are incorporated herein by reference in their entirety for all purposes.

Figure 2:
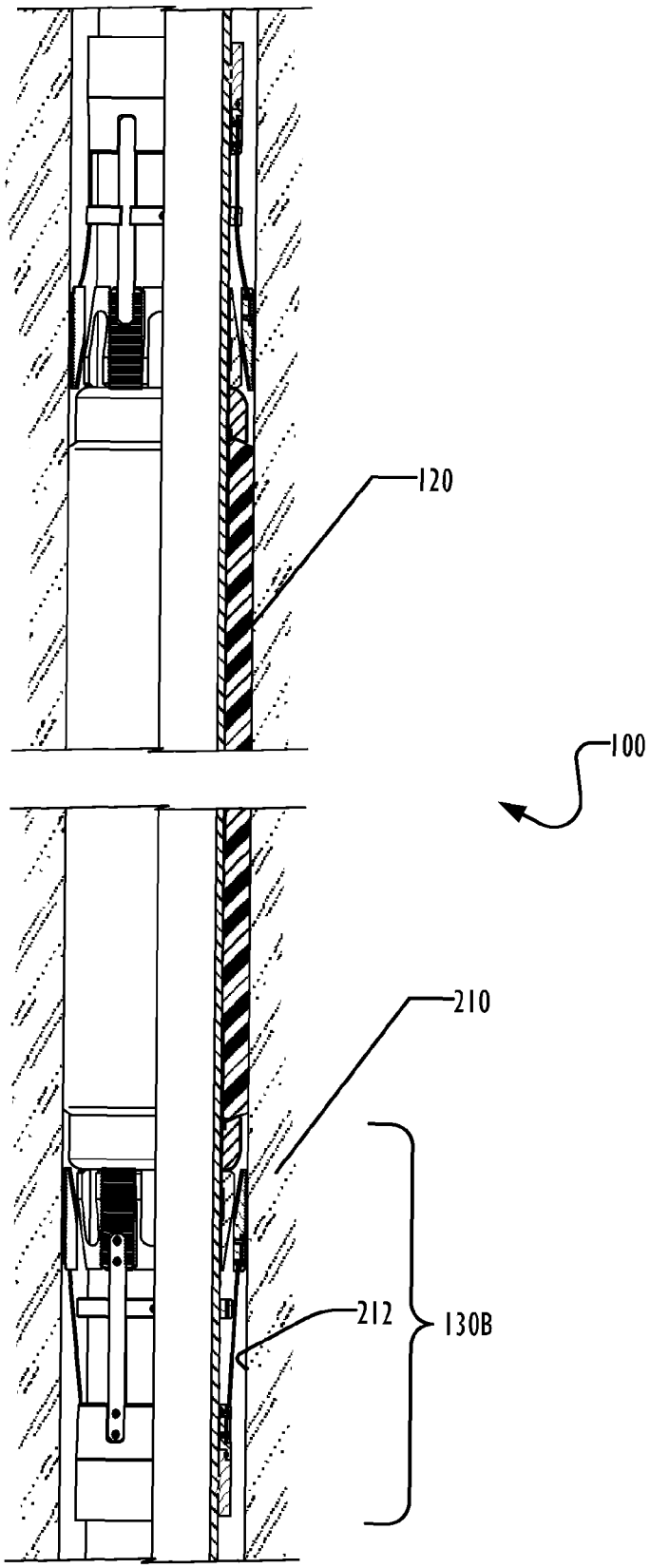
FIG. 2 is a cutaway view illustrating the packer of FIG. 1 deployed and engaged in tubing.

The swellable element 120 comprises a sleeve of a swellable elastomer that expands in the presence of a predetermined activating agent, such as water, oil, or both. When deployed downhole and subjected to the activating agent, as illustrated in FIG. 2, the swellable element 120 swells in response to the activating agent, and engages a surrounding sidewall 212 of a tubular or casing 210. The packer 100 may also be deployed in an open hole.

When the swellable element 120 radially swells over time in response to the activating agent to engage the tubular 210, it also swells axially. The axial expansion of the swellable element 120 activates the slip mechanisms 130A-B, causing them to engage the surrounding sidewall 212 of the tubular or casing, as illustrated in FIG. 2. When engaged, the wickers 350 of the slip mechanisms 130A-B resist axial movement of the packer 100 in one or both axial directions, depending on the configuration of the wickers 350. In one embodiment, the wickers 350 of slip mechanism 130A are oriented opposite the wickers 350 of the slip mechanism 130B, so that slip mechanism 130A provides resistance against axial movement in one direction, while slip mechanism 130B provides resistance against axial movement in the other direction.

Figure 3:
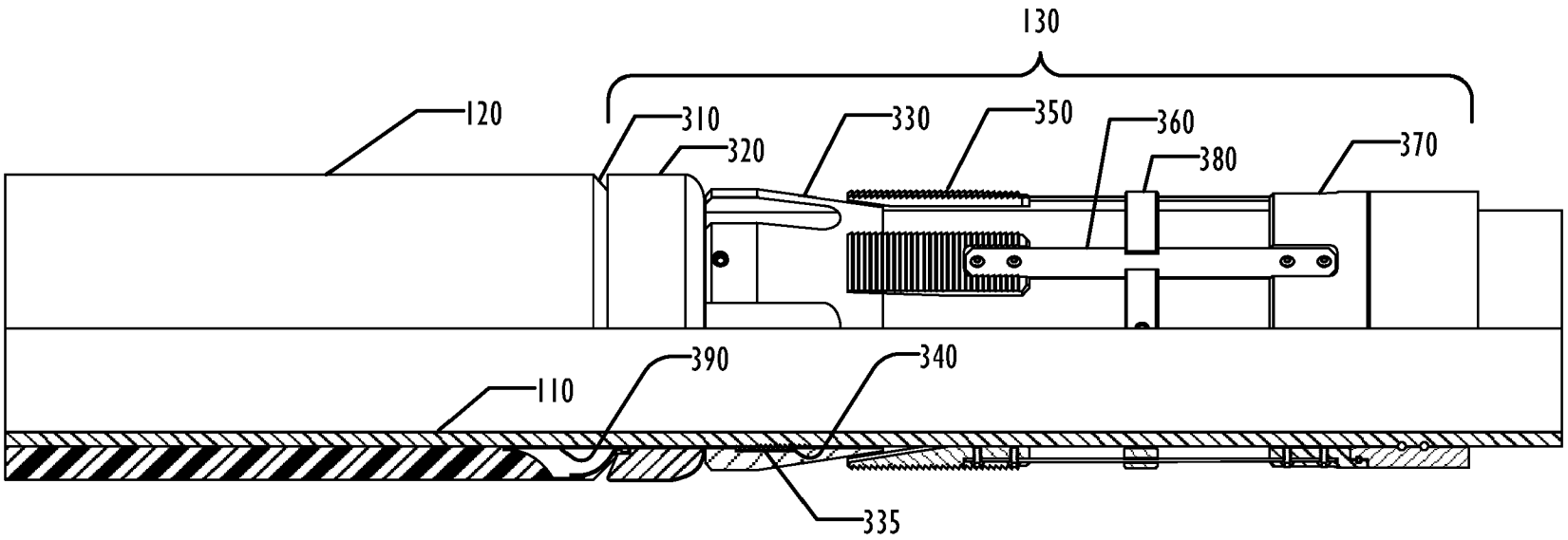
FIG. 3 is a cutaway view illustrating the slip mechanism of FIG. 1.

Details of a slip mechanism 130 are illustrated in a cutaway view in FIG. 3. In the unengaged condition, an end 310 of the swellable element 120 abuts a backup ring 320. Disposed adjacent the backup ring 320, a cone 330 disposed around the mandrel 110 may have a body lock ring 335 that engages a serrated surface 340 on the mandrel 110 to resist axial movement of the cone 330 in one direction and allow axial movement of the cone 330 in the other direction, typically in the direction of the slip 350. Although the backup ring 320 and cone 330 are illustrated in FIG. 3 as separate components, which may facilitate manufacture, other embodiments may combine those components into a single component.

In the embodiment illustrated in FIG. 3, slip wickers 350 are positioned on the mandrel 110 distal the cone 330 from the swellable element 120. The slip wickers 350 may have wedged faces that ride on the cone 330 when the cone 330 is moved towards the slip wickers 350. The wickers 350 are mounted with a slip cage, comprising collar 370 and spring arms 360. The spring arms 360 connect to the slip wickers 350 and attach to the collar 370, which is affixed to the mandrel 110. In one embodiment, a brace 380 disposed on the mandrel 110 holds the spring arms 360 at an intermediate point along their length to control their bend. The slip mechanism 130 may have any desired number of individual slip wickers 350 and spring arms 360 disposed around the mandrel 110.

An area of the mandrel 110 between the swellable element 120 and backup ring 320 may have a coating 390 to keep the swellable elastomer of the element 120 from bonding to the mandrel 110. This allows the end portion 310 of the swellable element 120 to swell axially, urging the backup ring 320 against the cone 330. In one embodiment, the backup ring 320 may be composed of metal and may be configured to retain the end portion 310 of swellable element 120, preventing it from moving radially away from the mandrel 110.

When pushed by the end portion 310 of the swelling element 120, the cone 330 slides axially along the mandrel 110. In one embodiment, the body lock ring 335 between the cone 330 and the mandrel 110 ratchets along the serrated surface 340 of the mandrel 110, preventing the cone 140 from moving back on the mandrel 110. As the cone 330 moves, the wedged end of the slip wicker 350 rides up the cone 330, causing the outer teeth of the slip wicker 350 to engage with the surrounding sidewall 212 of the casing or tubular 210, as illustrated in FIG. 2.

The construction of the slip mechanism 130 is illustrative and only by way of example, and other types and constructions of slip mechanisms may be used as desired that are deployed by the axial expansion of the swellable element 120. In one embodiment, such as is illustrated in FIG. 1, both ends of the packer 100 may have the arrangement of components for the slip mechanism 130 illustrated in FIG. 3, oriented in axially opposite directions, for deployment by axial expansion of the swellable element 120 in both directions.

Figure 4:
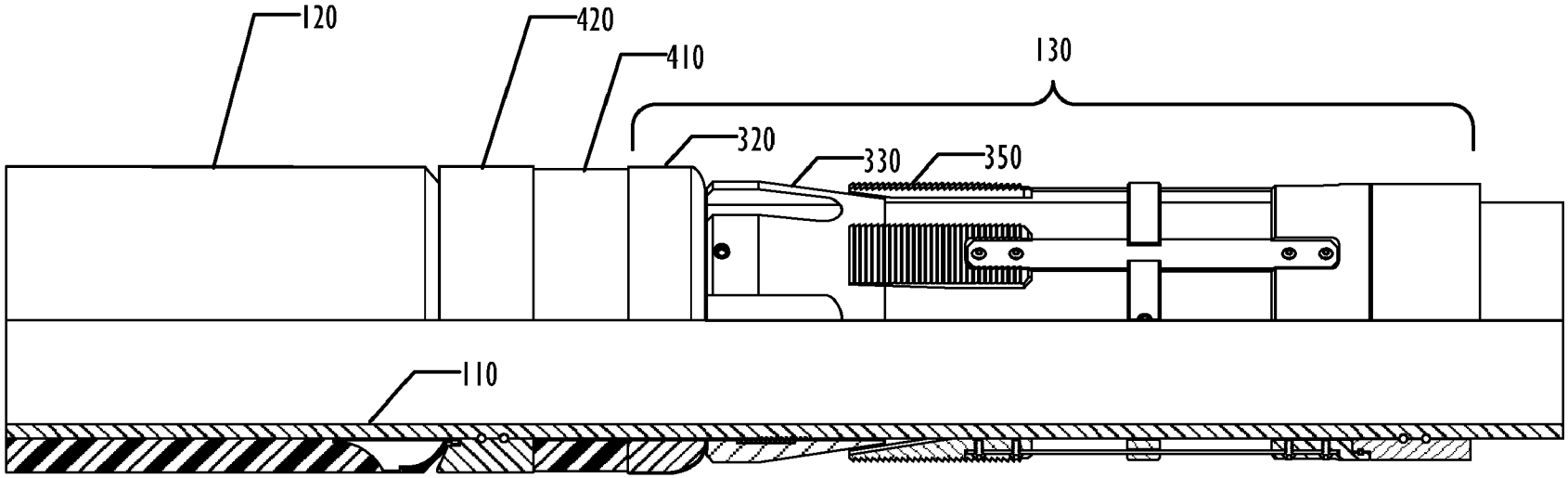
FIG. 4 is a cutaway view illustrating a slip mechanism for a swellable packer according to one embodiment.

In another embodiment, illustrated in cutaway view in FIG. 4, the slip mechanism 130 has a similar arrangement, but in this embodiment, a separate swellable sleeve 410 activates the slip mechanism 130, instead of the swellable element 120. As illustrated in FIG. 4, a swellable packing element 120 is disposed on the mandrel 110, and a gage or retention ring 420 affixed to the mandrel 110 retains the swellable packing element 120, limiting axial expansion on the mandrel 110. As in the embodiments described previously, the packing element 120 may be a swellable element, but in this embodiment, it may be any other type of packing element, such as an inflatable packing element or a compressible elastomer.

The separate swellable sleeve 410 is disposed on the mandrel 110 opposite the retention ring 420. As in the previously described embodiments, the swellable sleeve 410 is expandable axially toward the backup ring 320 in the presence of a predetermined activating agent, which may be different from the activating agent used for the swellable element 120. When urged by axial expansion of the swellable sleeve 410, the backup ring 320 pushes the cone 330 against the wedged end of the slip wickers 350 causing them to radially expand and engage the surrounding sidewall 212. In one embodiment, the swellable sleeve 410 is not bonded to the mandrel 110 so the sleeve 410 can boost and further wedge the slip wickers 350 if the mandrel 110 is moved. As with the previously described embodiments, both ends of the packer 100 may have a similar arrangement of swellable components for deploying the slip mechanism 130.

In this embodiment, a blocking ring 335 similar to that illustrated in FIG. 3 (not shown in FIG. 4) may be used to restrict axial movement of the slip collar 370 in one direction, similar to the movement restriction provided for the cone in the embodiment illustrated in FIG. 3.

As shown in FIG. 4, the swellable sleeve used to activate the slip mechanisms 130 when activated is retained by the gage ring 420, allowing axial expansion only in the direction of the slip mechanism 130. If the mandrel 110 is moved, the dedicated swellable sleeve 160 may be urged by the gage ring axially toward the slip mechanism 130, further pushing the cone 330 under the slip wickers 350 making them bite harder into the surrounding sidewall 210 with.

In one embodiment, a packer 100 may have one slip mechanism 130 on one end, deployed by axial expansion of the swellable element 120 as illustrated in FIG. 3, and another slip mechanism 130 on the other end, deployed by axial expansion of the swellable sleeve 160, as illustrated in FIG. 4.

Figure 5:
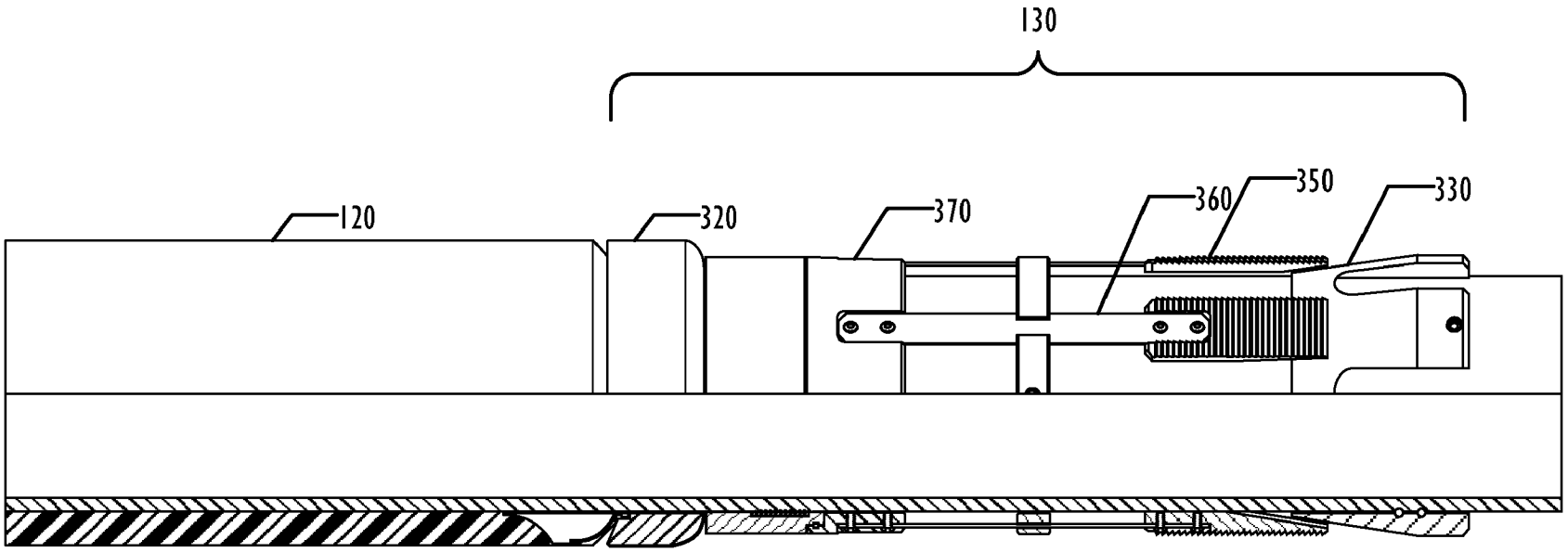
FIG. 5 is a cutaway view illustrating a reverse arrangement of a slip mechanism for a swellable packer accord to one embodiment.

In the embodiment illustrated in FIGS. 3 and 4, the cone 330 is moved by the swelling of the swellable element 120 or swellable sleeve 410. In other embodiments, a reverse arrangement may be used as illustrated in FIG. 5. In such an embodiment, instead of the cone 330 being moved by the swellable element 120, the collar 370 having the slip wickers 350 attached by arms 360 may be disposed adjacent the backup ring 124 and moved axially relative to the affixed cone 330, causing radial movement of the slip wickers 350 and engagement of the slip wickers 350 with the sidewall 210.

In other embodiments, a spring-loaded slip mechanism 130 is triggered by the axial expansion of the swellable element 120. The cone 330, once released by the triggering, is urged by a spring toward the slips 350, activating the slip mechanism 130.

Figure 6:
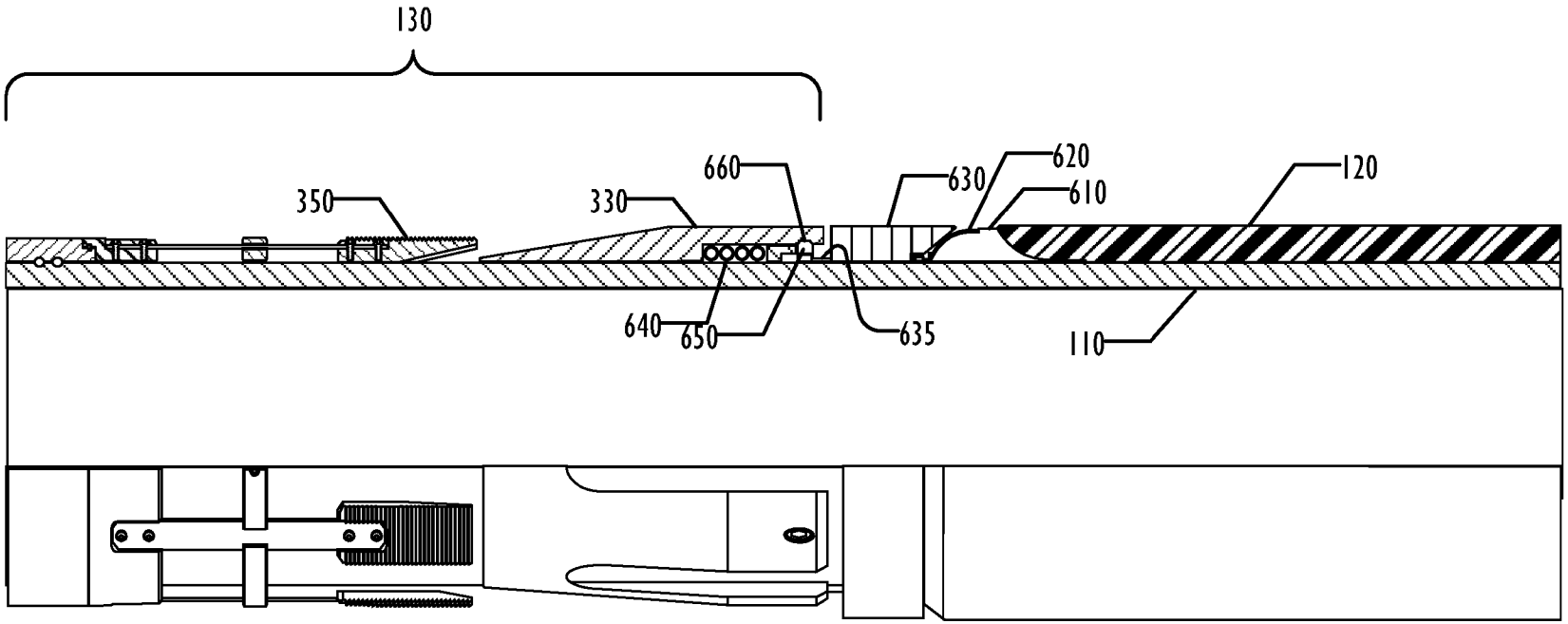
FIG. 6 is a cutaway view illustrating a packer having a swellable element and a spring-loaded slip mechanism according to one embodiment.

FIG. 6 is a cutaway view illustrating one embodiment in which axial expansion of the swellable element 120 activates a triggering mechanism comprising a backing ring 630 and a dog 650. A retaining ring 620 and elastomer 610 form an anti-extrusion device positioned at the end of the swellable member 120. The dog 650 is initially engaged with a slot or groove 660 formed in the cone 330 and prevents axial movement of the cone 330. As the swellable member 120 axially expands, pressure on the elastomer member 610 causes the metallic retaining ring 620, which is fixed to the mandrel 110 distal to the swellable element 120, to expand radially outwardly. The radial expansion of the retaining ring 620 urges the backup ring 630 towards the cone 330, allowing the dog 650 to fall into slot 635. The cone 330 is thus released by the triggering mechanism, allowing spring 640 to urge the cone 330 toward the slips 350, thus activating the slip mechanism 130.

Figure 7:
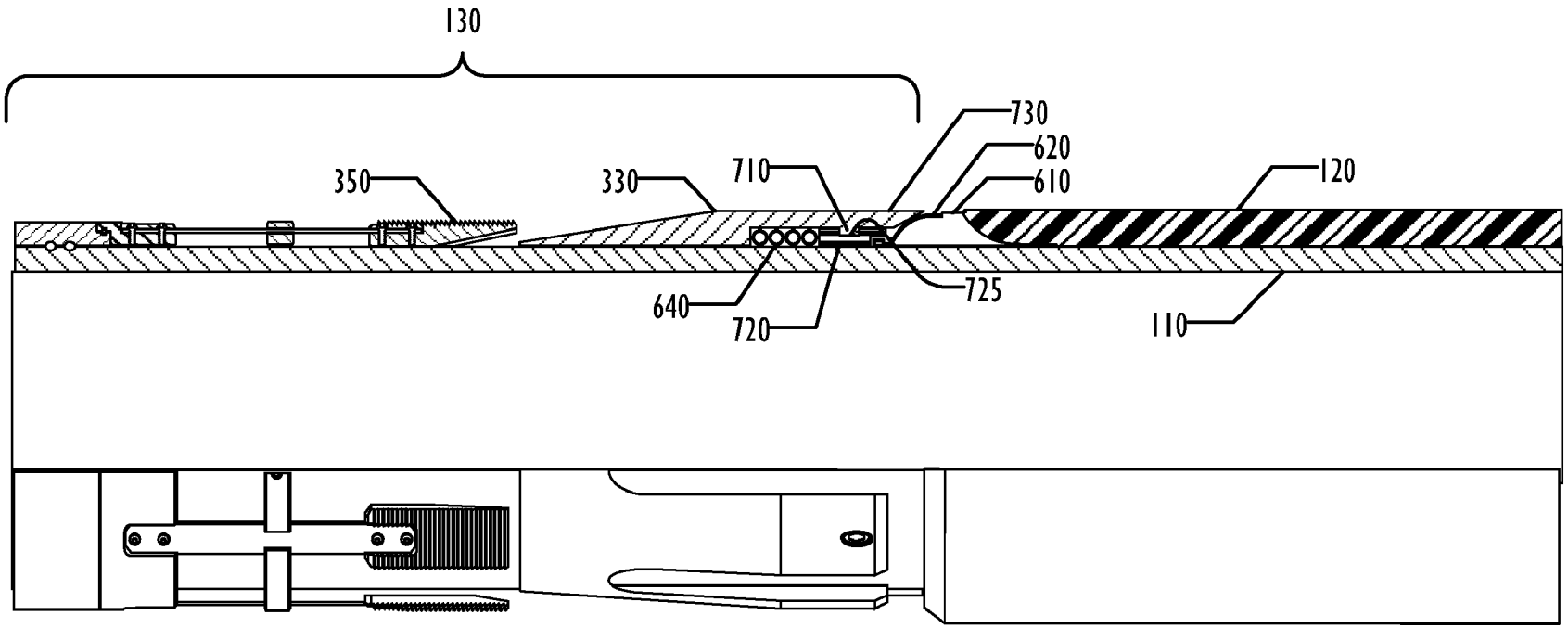
FIG. 7 is a cutaway view illustrating a packer having a swellable element and a spring-loaded slip mechanism according to another embodiment.

FIG. 7 is a cutaway view illustrating another spring-loaded embodiment. As with the embodiment illustrated in FIG. 6, a retaining ring 620 and elastomer 610 form an anti-extrusion device positioned at the end of the swellable member 120. In this embodiment, the triggering mechanism comprises a tab 710 formed in the cone 330, which is initially engaged in a groove or slot 725 of a holding ring 720 that is fixed to the mandrel 110. Radial expansion of the retaining ring 620 caused by axial expansion of the swellable element 120 urges a tab portion 730 of the cone 330 radially outwardly. The movement of the tab portion 730 disengages the tab 710 from the slot 725, triggering the trigger mechanism. The cone 330, once freed from the holding ring 720, is urged by the spring 640 toward the slips 350, thus activating the slip mechanism 130.

The embodiments of FIG. 6 and FIG. 7 illustrate a slip mechanism 130 wherein the spring-loaded cone 330 is urged toward the slips 350. As in the embodiment illustrated in FIG. 5, other embodiments may spring load the slips 350, so that activation of the slip mechanism 130 urges the slips 350 toward the cone 330.

Thus, in various embodiments axial swelling of the swellable element 120 causes activation of a slip mechanism 130. In some embodiments, the axial swelling directly acts on the slip mechanism 130. In other embodiments, the axial swelling triggers a trigger mechanism for a spring-loaded slip mechanism 130.

It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

I claim:

1. A packer, comprising:

a mandrel;

an axially swellable element disposed on the mandrel; and a first slip mechanism disposed on the mandrel with the axially swellable element, the slip mechanism activated by axial swelling of the element.

2. The packer of claim 1, wherein the axially swellable element is a radially swellable packing element.

3. The packer of claim 1, wherein the first slip mechanism comprises a backup ring disposed on the mandrel with an end of the axially swellable element, the backup ring being moveable axially along the mandrel.

4. The packer of claim 1, wherein the first slip mechanism comprises:

a cone disposed on the mandrel, a slip cage; and a slip mounted with the slip cage, the slip disposed with the cone, and radially outwardly movable upon engagement with the cone.

5. The packer of claim 4, wherein the first slip mechanism further comprises:

a spring, disposed with the cone; and a triggering mechanism, triggered by axial swelling of the element, the triggering mechanism when triggered allowing the spring to urge the cone axially toward the slip.

6. The packer of claim 4, wherein the slip cage is fixedly disposed on the mandrel, and wherein axial expansion of the axially swellable element urges the cone axially toward the slip.

7. The packer of claim 4, wherein the first slip mechanism further comprises a body lock ring configured to resist axial movement of a moveable portion of the first slip mechanism in one direction.

8. The packer of claim 1, further comprising a second slip mechanism disposed on the mandrel with the axially swellable element, distal to the first slip mechanism.

9. The packer of claim 1, further comprising:

a coating disposed on a surface of the mandrel at an end portion of the axially swellable element, the coating configured to prevent bonding of the end portion of the axially swellable element to the surface of the mandrel.

10. A swellable element system for disposal on a mandrel, comprising:

an elastomeric element, configured to swell axially when subjected to a predetermined activating agent;

a backup ring, moveably disposed with an end portion of the elastomeric element, configured to retain the end portion of the elastomeric element upon axial expansion of the elastomeric element; and a coating for disposal at the end portion of the elastomeric element, configured to prevent bonding of the end portion of the elastomeric element with the mandrel.

11. The swellable element system of claim 10, wherein the elastomeric element is a radially swellable packing element.

12. The swellable element system of claim 10, further comprising:

a retention ring, fixedly disposable on the mandrel with the elastomeric element distal to the backup ring.

13. The swellable element system of claim 10, further comprising:

a packing element, configured for radially outward expansion.

14. The swellable element system of claim 10, wherein the elastomeric element is movably disposable on the mandrel.

15. The swellable element system of claim 10, wherein the elastomeric element is fixedly disposable on the mandrel.

16. A downhole tool setting method, comprising:

deploying a packer having a swellable element downhole;

activating the swellable element to swell axially on the packer; and activating a slip mechanism of the packer responsive to axial swelling of the swellable element.

17. The method of claim 16, wherein the act of activating the swellable element comprises: activating a swellable sleeve element separate from a packing element of the packer.

18. The method of claim 16, wherein the act of activating a slip mechanism of the packer responsive to axial swelling of the swellable element comprises:

urging axially by the swellable element a cone of the slip mechanism towards a slip of the slip mechanism; and urging the slip radially outwardly by the cone.

19. The method of claim 16, wherein the act of activating a slip mechanism of the packer responsive to axial swelling of the swellable element comprises:

triggering by axial swelling of the swellable element a trigger mechanism of a spring-loaded slip mechanism, allowing axial movement of a first portion of the slip mechanism; and urging the first portion of the slip mechanism toward a second portion of the slip mechanism with a spring, responsive to the act of triggering.

20. The method of claim 16, further comprising:

urging the swellable element toward the slip mechanism by movement of a mandrel about which the swellable element is disposed.

* * * * *